US011761109B2

(12) United States Patent
Tarutani et al.

(10) Patent No.: US 11,761,109 B2
(45) **Date of Patent: *Sep. 19, 2023**

(54) TERMINAL MATERIAL FOR CONNECTOR

(71) Applicant: MITSUBISHI MATERIALS CORPORATION, Tokyo (JP)

(72) Inventors: Yoshie Tarutani, Naka (JP); Kenji Kubota, Naka (JP); Naoki Katou, Tokyo (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/798,659

(22) PCT Filed: Jan. 28, 2021

(86) PCT No.: PCT/JP2021/003053

§ 371 (c)(1),
(2) Date: Aug. 10, 2022

(87) PCT Pub. No.: WO2021/166581

PCT Pub. Date: Aug. 26, 2021

(65) Prior Publication Data

US 2023/0111976 A1 Apr. 13, 2023

(30) Foreign Application Priority Data

Feb. 20, 2020 (JP) ..... 2020-027614

(51) Int. Cl.

| | |
|---|---|
| ***C25D 5/12*** | (2006.01) |
| ***C25D 3/46*** | (2006.01) |
| ***C25D 3/12*** | (2006.01) |
| ***H01R 13/03*** | (2006.01) |
| ***C25D 3/56*** | (2006.01) |
| ***C25D 5/16*** | (2006.01) |

(52) U.S. Cl.
CPC ... *C25D 5/12* (2013.01); *C25D 3/12* (2013.01); *C25D 3/46* (2013.01); *C25D 3/56* (2013.01); *C25D 5/16* (2013.01); *H01R 13/03* (2013.01)

(58) Field of Classification Search
CPC ..... C25D 5/12; C25D 3/12; C25D 3/46; C25D 3/56; C25D 5/16; H01R 13/03
See application file for complete search history.

(56) References Cited

U.S. PATENT DOCUMENTS

| | | | |
|---|---|---|---|
| 2005/0037229 A1 | 2/2005 | Tanaka | |
| 2010/0186993 A1 | 7/2010 | Yamaguchi et al. | |
| 2013/0196174 A1* | 8/2013 | Zhang-Beglinger et al. | ..... C22C 5/06 428/647 |

(Continued)

FOREIGN PATENT DOCUMENTS

| | | | |
|---|---|---|---|
| JP | 2007-177329 | A | 7/2007 |
| JP | 2008-270192 | A | 11/2008 |
| JP | 2015-117424 | A | 6/2015 |

(Continued)

*Primary Examiner* — Wojciech Haske
(74) *Attorney, Agent, or Firm* — Locke Lord LLP

(57) ABSTRACT

A terminal material for a connector provided with a base material in which at least a surface layer is made of copper or copper alloy, a nickel-plating layer made of nickel or nickel alloy and formed on a surface of the base material, a silver-nickel alloy plating layer made of silver-nickel alloy and formed on at least a part of the nickel-plating layer, and a silver-plating layer made of silver and formed on the silver-nickel alloy plating layer; the silver-nickel alloy plating layer has a film thickness 0.05 μm or more and less than 0.50 μm and a nickel content 0.03 at% or more and 1.00 at% or less.

4 Claims, 1 Drawing Sheet

(56) References Cited

U.S. PATENT DOCUMENTS

| | | | | |
|---|---|---|---|---|
| 2015/0079421 | A1* | 3/2015 | Myers et al. | H01R 13/03 427/125 |
| 2015/0079422 | A1* | 3/2015 | Sunaga et al. | C23C 14/165 428/673 |
| 2016/0254608 | A1 | 9/2016 | Takahashi | |
| 2021/0158990 | A1* | 5/2021 | Kubota et al. | C25D 3/46 |

FOREIGN PATENT DOCUMENTS

| | | | | |
|---|---|---|---|---|
| JP | 2016-065316 | A | 4/2016 | |
| JP | 2018-104776 | A | 7/2018 | |
| JP | 2019031732 | A * | 2/2019 | B32B 15/01 |
| WO | 2013150690 | A1* | 10/2013 | B32B 15/01 |

* cited by examiner

TERMINAL MATERIAL FOR CONNECTOR

BACKGROUND OF THE INVENTION

Technical Field

The present invention relates to a terminal material for a connector in which a useful film is provided for connection of electric wiring in an automobile, a consumer apparatus, or the like. Priority is claimed on Japanese Patent Application No. 2020-027614, filed Feb. 20, 2020, the content of which is incorporated herein by reference.

Background Art

Conventionally, an on-vehicle connector used for connection of electric wiring of automobile or the like has been known. A pair of terminals used for the on-vehicle connector (on-vehicle terminals) are designed to electrically connect by contacting a contact piece provided in a female terminal with a male terminal inserted into the female terminal at a predetermined contact pressure.

As such a connector (terminal), generally, a terminal with tin plating in which tin plating is carried on a copper or a copper alloy plate and reflowing treatment is subjected to has been largely used. However, in recent years, purposes of a terminal are increased with larger electric current and higher voltage in which precious metal such as silver or the like is plated, more large current can be passed with excellent in heat resistance and abrasion resistance.

As an on-vehicle terminal in which the heat resistance and the abrasion resistance are required, for example, in a plating material for an electric-electronic part disclosed in Patent Literature 1, a base-plating layer made of any one of or alloy of Ni, Co, and Fe is formed on a surface of a conductive base material, an intermediate plating layer made of Cu or Cu alloy is formed on the base-plating layer, and an alloy layer is formed on the intermediate plating layer. It is described that this alloy layer is made by alloying by selective thermal diffusion of an Sn plating layer and a metal-plating layer made of Ag or In.

Patent Literature 2 discloses a material for a movable contact having a conductive base material, a base layer formed on the conductive base material, an intermediate layer formed on the base layer, and an outermost layer made of silver or silver alloy formed on the intermediate layer. It is described that the base layer is made of nickel or nickel alloy, or cobalt or cobalt alloy, and the intermediate layer is made of copper or copper alloy in this material.

Citation List

Patent Literature 1: Japanese Unexamined Patent Application First Publication No. 2007- 177329

Patent Literature 2: Japanese Unexamined Patent Application First Publication No. 2015- 117424

SUMMARY OF INVENTION

Technical Problem

A silver layer provided on a surface of a terminal material is excellent in heat resistance and abrasion resistance since it is not oxidized even in high-temperature environment. On the other, a base layer has a function of preventing diffusion of copper from the base material. Since tin and nickel form an intermetallic compound, adhesiveness between a nickel base layer and tin plating is good.

However, in a case in which the silver layer on the surface is provided on the nickel base layer, the adhesiveness is poor since nickel and silver do not form an intermetallic compound. Moreover, since silver is hard to be oxidized and the silver layer cannot obstruct oxygen from entering in, oxygen diffused into the silver layer and reaches the nickel layer becomes nickel oxide in the nickel layer, so that there is a risk of occurring peeling.

Accordingly, in the terminal materials of these patent literatures, the intermediate layer made of copper or copper alloy is formed between the silver layer and the nickel layer. Copper diffuses into the silver layer under the high-temperature environment but does not form an intermetallic compound with silver, so that oxygen is distributed to a grain boundary of the silver layer and prevented from entering in. However, if copper is diffused up to the surface of the silver layer, it is oxidized on the surface and there is a defect of increase of the contact resistance.

The present invention is achieved in consideration of the above circumstances, and has an object to provide a terminal material for a connector in which the heat resistance is further improved, the contact resistance is not increased even in the high-temperature environment, to have the high abrasion resistance.

Solution to Problem

A terminal material for a connector of the present invention is provided with a base material in which at least a surface layer is made of copper or copper alloy; a nickel-plating layer made of nickel or nickel alloy and provided on a surface of the base material; a silver-nickel alloy plating layer made of silver-nickel alloy and provided on at least a part of the nickel-plating layer; and a silver-plating layer made of silver and provided on the silver-nickel alloy plating layer; and in this terminal material, the silver-nickel alloy plating layer has 0.05 μm or more and less than 0.50 μm of a film thickness and 0.03 at% or more and 1.00 at% or less of nickel content.

Since the silver-plating layer which is relatively soft is provided on the surface and the silver-nickel alloy plating layer which is harder than the silver-plating layer is provided below it, the lubricant effect is excellent and the abrasion resistance is improved. Moreover, the surface of the silver-plating layer is not easily oxidized even in the high-temperature environment, and the contact resistance can be restrained from increasing. Furthermore, design of the surface is improved by the glossiness of silver.

In this terminal material for a connector, since the silver-nickel alloy plating layer provided between the silver-plating layer on the surface and the nickel-plating layer which is the ground contains both components of silver and nickel, it can improve adhesiveness between these layers.

Unlike the intermediate layer made of copper or copper alloy described in Patent Literature, nickel in the silver-nickel alloy plating layer is not easily diffused into the silver-plating layer even in the high-temperature environment, so the contact resistance can be restrained from increasing.

Moreover, even if oxygen enters through the silver-plating layer on the surface in the high-temperature environment, nickel in the silver-nickel alloy plating layer reacts with oxygen, so that the silver-nickel alloy plating layer functions as a sacrificing layer to prevent the oxygen from coming up to the nickel-plating layer. Accordingly, the peeling by oxidizing of the nickel-plating layer can be restrained.

In this case, if nickel in the silver-nickel alloy plating layer is oxidized, since nickel is diffused on a boundary surface (grain boundary) of silver, the layer is not peeled off. Accordingly, deterioration of the performance in the high-temperature environment can be restrained and the excellent abrasion resistance can be maintained.

Moreover, since nickel has the higher melting point than copper, it is not easily diffused by heat. Accordingly, unlike copper, nickel is not easily concentrated on the outermost surface even in the high-temperature environment, it is possible to restrain the increase of the contact resistance.

If the nickel content in the silver-nickel alloy plating layer is less than 0.03 at%, the heat resistance is deteriorated and it is easily peeled off. If the nickel content in the silver-nickel alloy plating layer exceeds 1.00 at%, the conductor resistance of the silver-nickel alloy plating layer increases, and the contact resistance in the high-temperature environment is also easily increased.

Since the silver-nickel alloy plating layer functions as the sacrificing layer preventing oxygen from entering the nickel-plating layer as described above, an amount of nickel reacting with oxygen is small if the film thickness is less than 0.05 μm, and the heat resistance cannot be improved. On the other, if the film thickness of the silver-nickel alloy plating layer is 0.50 μm or more, the effect is saturated and it is useless in cost.

As one aspect of the terminal material for a connector according to the present invention, a film thickness of the silver-plating layer is preferably 0.5 μm or more and 20.0 μm or less. If the film thickness of the silver-plating layer is less than 0.5 μm, it is worn in early times and easily disappeared, and the effect of improving the abrasion resistance is poor. If the thickness exceeds 20.0 μm, the soft silver-plating layer is thick, and the friction coefficient tends to be increased. In addition, the film thickness of the silver-plating layer is larger than the film thickness of the silver-nickel alloy plating layer.

As another aspect of the terminal material for a connector according to the present invention, the silver-plating layer is preferably made of silver with a purity 99.99% or more by mass except C, H, S, O, and N which are gas components. If a large amount of impurities are contained in the silver-plating layer, the contact resistance is high. "Except C, H, S, O, and N" means to exclude gas components.

Advantageous Effects of Invention

According to the present invention, the heat resistance of the connector is improved, the contact resistance is not increased even in the high-temperature environment, and the peeling can be restrained.

DESCRIPTION OF EMBODIMENTS

An embodiment of the present invention will be explained referring the drawings below.

Structure of Terminal Material for Connector

Figure 1:
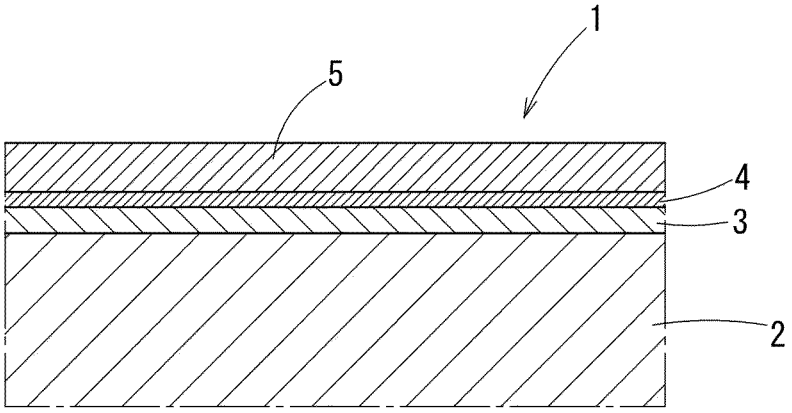
FIG. 1 It is a cross sectional view schematically showing a terminal material for a connector according to an embodiment of the present invention.

A terminal material 1 for a connector of the present embodiment is provided with, as schematically showing a cross section in FIG. 1, a base material 2 having a plate shape in which at least a surface layer is made of copper or copper alloy, a nickel-plating layer 3 provided on an upper surface of the base material 2 and made of nickel or nickel alloy, a silver-nickel alloy plating layer 4 provided on at least a part of the nickel-plating layer 3 and made of silver-nickel alloy, and a silver-plating layer 5 provided on an upper surface of the silver-nickel alloy plating layer 4 and made of silver.

The base material 2 is not limited in the composition if the surface layer is copper or copper alloy. In the present embodiment, as shown in FIG. 1, the base material 2 is a plate material made of copper or copper alloy; however, it may be a plated material in which copper plating or copper-alloy plating is made on a surface of a mother bacterial. In this case, as the mother material, copper or copper alloy such as oxygen-free copper (C10200), Cu-Mg type copper alloy (C18665) and the like can be applied.

The nickel-plating layer 3 is formed by performing nickel or nickel alloy plating on the base material 2 and covers the base material 2. The nickel-plating layer 3 has a function of restraining diffusion of Cu component from the base material 2 to the silver-plating layer 5. A film thickness of the nickel-plating layer 3 is not specifically limited: 0.2 μm or more and 5.0 μm or less is preferable; more preferably, 0.5 μm or more and 2.0 μm or less.

If the film thickness of the nickel-plating layer 3 is less than 0.2 μm, there is a possibility that the Cu component diffuses from the base material 2 into the silver-plating layer 5 in the high-temperature environment to increase the contact resistance value of the silver-plating layer 5 and the heat resistance is deteriorated. Conversely, if the thickness of the nickel-plating layer exceeds 5.0 μm, there is a risk of cracking by bending machining. Incidentally, the composition of the nickel-plating layer 3 is not specifically limited if it is made of nickel or nickel alloy.

The silver-nickel alloy layer 4 is formed by carrying out a silver-strike plating on the nickel-plating layer 3 and then carrying out a silver-nickel alloy plating. The silver-nickel alloy layer 4 is alloy of silver and nickel: intermetallic compound is not generated between silver and nickel, so cracks when the bending machining are restrained.

Nickel content in the silver-nickel alloy layer 4 is 0.03 at% or more and 1.00 at% or less; more preferably, 0.05 at% or more and 1.00 at% or less.

Nickel has the higher melting point than that of copper: it is hardly diffused and hard to be concentrated in the outermost surface even in the high-temperature environment unlike copper. Accordingly, it is possible to restrain increase of the contact resistance in the high-temperature environment. If the nickel content in the silver-nickel alloy plating layer 4 is less than 0.03 at%, the heat resistance and the abrasion resistance are deteriorated; if it exceeds 1.00 at%, the conductor resistance of the silver-nickel alloy plating layer 4 increases, and moreover, the contact resistance is easily increased in the high-temperature environment.

A film thickness of the silver-nickel alloy plating layer 4 is set to be 0.05 μm or more and less than 0.50 μm; more preferably, 0.10 μm or more and less than 0.50 μm. The silver-nickel alloy plating layer 4 has a function as a sacrificing layer obstructing the achievement of oxygen to the nickel-plating layer 3 which is the ground layer thereof by reacting oxygen entering from the surface with nickel;

accordingly, it is enough to have a degree of the film thickness which can show the function.

If the film thickness of the silver-nickel alloy plating layer 4 is less than 0.05 μm, the effect of preventing from entering of oxygen to the nickel-plating layer 3 in the high-temperature environment is not sufficient, and it is easy to be peeled off when sliding and the abrasion resistance is deteriorated. If the film thickness of the silver-nickel alloy plating layer 4 is 0.50 μm or more, the effect is saturated and it is useless in cost.

The silver-plating layer 5 is formed by carrying out silver plating on the silver-nickel alloy plating layer 4. The silver-plating layer 5 is relatively soft and the hard silver-nickel alloy plating layer 4 is formed therebelow, so it gives excellent lubrication effect and contributes to improvement of the abrasion resistance. Moreover, it is not easily oxidized even in the high-temperature environment and the contact resistance can be prevented from increasing. Furthermore, design of the surface is improved by gloss of silver.

A film thickness of the silver-plating layer 5 is preferably 0.5 μm or more and 20.0 μm or less. If the film thickness of the silver-plating layer 5 is less than 0.5 μm, it is easily worn away and disappeared in early time, and the effect of the increase of the abrasion resistance is poor. If the thickness exceeds 20.0 μm, since the soft silver-plating layer 5 is thick, the friction coefficient increases. Note that the film thickness of the silver-plating layer 5 is larger than the film thickness of the silver-nickel alloy plating layer 4.

It is preferable that the silver-plating layer 5 be made of silver with purity 99.99% by mass or more except C, H, S, O, and N which are gas components. If concentration of silver in the silver-plating layer 5 is less than 99.99% by mass, the contact resistance increases owing to impurities. "Except C, H, S, O, and N" means exception of gas components.

Next, a method of producing the terminal material 1 for a connector will be explained. This method of producing is provided with a pretreatment step cleaning a plate material to be the base material 2 in which at least a surface layer is made of copper or copper alloy, a nickel plating step forming the nickel-plating layer 3 on the base material 2, a silver-strike plating step carrying out the silver-strike plating on the nickel-plating layer 3, a silver-nickel alloy plating step forming the silver-nickel alloy plating layer 4 after the silver-strike plating, and a silver-plating step carrying out a silver plating on the silver-nickel alloy plating layer 4 to form the silver-plating layer 5.

[Pretreatment Step] First, the plate material in which at least the surface layer is made of copper or copper alloy is prepared, and the plate material is subjected to the pretreatment cleaning the surface by performing alkaline electrolytic degreasing, etching, pickling and the like to form the base material 2.

[Nickel-Plating Step] The surface of the base material 2 is subjected to plating made of nickel or nickel alloy to form the nickel-plating layer 3. For example, using a nickel-plating bath containing 300 g/L of nickel sulfamate, 30 g/L of nickel (II) chloride hexahydrate, and 30 g/L of boric acid, the nickel plating is performed under conditions of bath temperature 45° C. and current density 5 A/dm$^2$.

The nickel-plating bath forming the nickel-plating layer 3 is not specifically limited if a dense film mainly composed of nickel is obtained. It is also applicable to perform electroplating using known Watt's bath.

[Silver-strike Plating Step] An activation treatment is carried out on the nickel-plating layer 3 using 5 to 10% by mass of potassium cyanide aqueous, and then the silver-strike plating is carried out on the nickel-plating layer 3 for a short time, so that the thin silver-plating layer (the silver-strike plating layer) is formed.

Composition of the silver-plating bath for performing the silver-strike plating is not specifically limited: for example, it contains 1 g/L to 5 g/L of silver cyanide (AgCN) and 80 g/L to 120 g/L of potassium cyanide (KCN).

By this silver-plating bath, using stainless steel (SUS316) as an anode, the silver-strike plating layer is formed by carrying out silver plating for about 30 seconds under conditions of bath temperature 25° C. and current density 3 A/dm$^2$. This silver-strike plating layer is hardly distinguished as a layer after the silver-nickel alloy plating is performed.

[Silver-Nickel Alloy Plating Step] The silver-nickel alloy plating is performed after the silver-strike plating to form the silver-nickel alloy plating layer 4. Composition of a plating bath for forming the silver-nickel alloy plating layer 4 contains, for example, silver cyanide (AgCN) 40 g/L to 60 g/L, potassium cyanide (KCN) 130 g/L to 200 g/L, potassium carbonate ($K_2CO_3$) 15 g/L to 35 g/L, nickel (II) potassium cyanide monohydrate ($2KCN \cdot Ni(CN)_2 \cdot H_2O$) 100 g/L to 200 g/L, and an additive for smoothly depositing the silver-nickel alloy plating layer 4. If no antimony is contained, the additive may be a general additive.

By using a pure silver plate as an anode in this plating bath and performing the silver-nickel alloy plating under conditions of bath temperature 20° C. to 30° C. and current density 5 A/dm$^2$ to 12 A/dm$^2$, the silver-nickel alloy plating layer 4 is formed with a nickel content 0.03 at% to 1.00 at% and a film thickness 0.05 μm or more and less than 0.50 μm. The plating bath for forming the silver-nickel alloy plating layer 4 is not limited to the above-described composition: if it is a cyanide bath and no antimony is contained in the additive, the composition is not specifically limited.

[Silver Plating Step] Composition of a silver-plating bath for forming the silver-plating layer 5 contains, for example, potassium silver cyanide ($K[Ag(CN)_2]$) 45 g/L to 60 g/L, potassium cyanide (KCN) 100 g/L to 150 g/L, potassium carbonate ($K_2CO_3$) 10 g/L to 30 g/L, and an additive. If no antimony is contained, the additive may be a general additive.

By using a pure silver plate as an anode in this plating bath and performing the silver plating under conditions of bath temperature 23° C. and current density 2 A/dm$^2$ to 5 A/dm$^2$, the silver-plating layer 5 is formed with a film thickness 0.5 μm or more and 20.0 μm or less. The plating bath for forming the silver-plating layer 5 is not limited to the above-described composition: if it is a cyanide bath and no antimony is contained in the additive, the composition is not specifically limited.

As described above, the terminal material 1 for a connector in which the nickel-plating layer 3, the silver-nickel alloy plating layer 4, and the silver-plating layer 5 are formed on the surface of the base material 2 is formed. Furthermore, by performing press machining and the like on the terminal material 1 for a connector, a terminal for a connector in which the silver-plating layer 5 is positioned on the surface is formed.

In addition, the above-described plating steps are carried out in order by soaking the base material 2 in the plating bath, so the plating layers 3, 4, and 5 are formed on both surfaces of the base material 2. Masking one surface of the base material 2, it is possible to form the plating layers 3, 4, and 5 only on the other surface.

In the terminal material 1 for a connector of the present embodiment, since the silver-plating layer 5 formed on the outermost surface is relatively soft and supported by the hard silver-nickel alloy plating layer 4 underneath, the lubricant effect improves the abrasion resistance. Moreover, since the surface is the silver-plating layer 5, the surface is not easily oxidized even in the high temperature environment, increase of the contact resistance can be restricted. Furthermore, silver glossiness improves the design of the surface.

The silver-nickel alloy plating layer 4 has a high hardness since nickel is contained, but the hardness of the silver-nickel alloy plating layer 4 can be prevented from excessively increased since the intermetallic compound is not generated between silver and nickel.

Moreover, since the silver-nickel alloy plating layer 4 formed between the silver-plating layer 5 and the nickel-plating layer 3 contains both silver and nickel components, the adhesiveness of these layers can be improved.

Since nickel has the higher melting point than that of copper, it is not easily diffused by heat and the concentration to the outermost surface does not easily occur unlikely copper. Accordingly, the heat resistance can be improved and increase of the contact resistance can be restrained. Moreover, the silver-nickel alloy plating layer 4 is formed on the silver-strike plating layer on the nickel-plating layer 3, so that it is prevented from peeling from the nickel-plating layer 3.

Since the silver-plating layer 5 on the surface does not react with oxygen, the oxygen easily enters inside in the high-temperature environment; however, even if the oxygen enters through the silver-plating layer 5, it reacts with nickel in the silver-nickel alloy plating layer 4, so the oxygen is prevented from arriving in the nickel-plating layer 3 as the under layer. Accordingly, the silver-nickel alloy plating layer 4 functions as the sacrificing layer, so that the nickel-plating layer 3 is prevented from peeling by oxidizing.

In this case, even if the nickel in the silver-nickel alloy plating layer 4 is oxidized, it does not come to be peeled off since the nickel in the silver-nickel alloy plating layer 4 is diffused. Accordingly, deterioration of the performance in the high-temperature environment can be restrained and the excellent abrasion resistance can be maintained.

In addition, the detailed structure of the present invention is not limited to the present embodiment and various modifications may be made without departing from the scope of the present invention. For example, in the above-described embodiment, the nickel-plating layer 3, the silver-nickel alloy plating layer 4, and the silver-plating layer 5 are formed on a whole area of the upper surface of the base material 2. It is not limited to this: for example, the nickel-plating layer 3 may be formed on a part of the upper surface of the base material 2 and the silver-nickel alloy plating layer 4 and the silver-plating layer 5 may be formed on that nickel-plating layer 3.

Alternatively, the silver-nickel alloy plating layer 4 and the silver-plating layer 5 may be formed on a part of the upper surface of the nickel-plating layer 3 formed on the whole area of the upper surface of the base material 2. That is to say, in a case in which the silver-nickel alloy plating layer 4 and the silver-plating layer 5 are not provided on the whole surface of the terminal material 1, it is preferable that at least a surface of a part to be a contact when it is formed into a terminal be the silver-plating layer 5.

EXAMPLES

A copper alloy (CDA No. C18665) plate was used as the base material and the respective steps were carried out as below.

[Pretreatment Step] The base material was subjected to alkaline electrolytic degreasing, etching, and pickling to clean the surface.

[Nickel-Plating Step] Using a plating bath containing 300 g/L of nickel sulfamate, 30 g/L of nickel (II) chloride hexahydrate, and 30 g/L of boric acid, under conditions of bath temperature 45° C., current density 5 A/dm$^2$, and an anode is a nickel plate, soaking the base material ion the plating bath and turning on electricity for 60 seconds, the nickel-plating layer 3 having the film thickness 1 μm.

[Silver-Strike Plating Step] Using a plating bath containing 2 g/L of silver cyanide (AgCN) and 100 g/L of potassium cyanide (KCN), under conditions of an anode is stainless steel (SUS316), the bath temperature 25° C., and the current density 3 A/dm$^2$, turning on electricity for 30 seconds to performing the silver-strike plating on the nickel-plating layer 3 to form the silver-strike plating layer.

[Silver-Nickel Alloy Plating Step] Using a plating bath containing silver cyanide (AgCN) 40 g/L, potassium cyanide (KCN) 150 g/L, potassium carbonate ($K_2CO_3$) 20 g/L, nickel (II) potassium cyanide monohydrate ($2KCN{\cdot}Ni(CN)_2{\cdot}H_2O$) 140 g/L, and an additive 20 ml//L, and an anode was a pure silver plate, bath temperature was 25° C., the silver-nickel alloy plating layer 4 was formed on the silver-strike plating layer.

Since nickel content in the silver-nickel alloy plating layer 4 is proportional to the current density of the plating treatment, by controlling the current density within 5 A/dm$^2$ to 12 A/dm$^2$, the nickel content in the silver-nickel alloy plating layer 4 was adjusted in 0.03 at% to 1.00 at%. Since the film thickness of the silver-nickel alloy plating layer 4 is proportional to plating time, the film thickness of the silver-nickel alloy plating layer 4 was adjusted by controlling the plating time in one second to 16 seconds.

[Silver Plating Step] Using a plating bath containing potassium silver cyanide ($K[Ag(CN)_2]$) 45 g/L, potassium cyanide (KCN) 100 g/L, potassium carbonate ($K_2CO_3$) 20 g/L, and a brightener (AgO-56 made by Atotech Japan K.K.) 4 ml, under conditions of bath temperature 23° C. and current density 4 A/dm$^2$, the silver-plating layer 5 is formed on the silver-nickel alloy plating layer 4.

As Comparative Examples, Sample 7 in which the silver-nickel alloy plating layer was not formed on the nickel-plating layer but the silver-plating layer was formed, and Samples 8 and 9 in which the nickel content in the silver-nickel alloy plating layer was out of a range of 0.03 at% to 1.00 at% were also produced.

Sample 10 in which a copper-plating layer was formed was produced as below instead of the silver-nickel alloy plating layer 4. That is, after the nickel-plating step, a copper-plating step and an activation treatment were carried out as follows before the silver-strike plating step; and after carrying out the silver-strike plating step, the silver-nickel alloy plating step was not carried out but the silver-plating step was carried out.

The copper-plating layer was formed by plating by using a plating bath containing copper sulfate pentahydrate ($CuSO_4{\cdot}5H_2O$) 200 g/L and sulfuric acid ($H_2SO_4$) 50 g/L, on conditions that the bath temperature 40° C., the current density 5 A/dm$^2$ and an anode was copper containing phosphorus.

This copper-plating layer was subjected to the activation treatment using 5 to 10% by mass of potassium cyanide aqueous solution, then the silver-strike plating and the silver-plating were carried out on the copper-plating layer as in Examples to form the silver-plating layer.

Regarding Samples 1 to 11 in which these plating layers were formed, the film thickness of the silver-nickel alloy plating layer, the nickel content in the silver-nickel alloy plating layer, and the film thickness of the silver-plating layer were measured. In Table 1, the silver-nickel alloy plating layer is indicated as "AgNi Layer", the silver-plating layer is indicated as "Ag Layer", and the nickel content is indicated as "Ni Content".

Measurement of Film Thickness of Plating Layer

Regarding the respective samples, sectional machining was performed by using a focused ion beam system (FIB: model No. SMI3050TB made by Seiko Instruments Inc.), film thicknesses of any three points were measured in a sectional SIM (Scanning Ion Microscopy) image on an inclined angle 60° and the average value thereof was converted into a real length to obtain a film thicknesses of the silver-nickel alloy plating layer and the silver-plating layer.

Measurement of Nickel Content (Ni Content)

Regarding the respective samples, using a high-frequency glow discharge-optical emission spectroscopy (rf-GD-OES (Radio Frequency Glow Discharge-Optical Emission Spectroscopy), elemental analysis was performed in a depth direction from the surface of the silver-plating layer on the following conditions, and the obtained value was converted into a quantitative value (at%) using a half quantity kit.

Measurement area: Circle with a diameter 4 mm
Used gas: Ultra-high purity Ar gas
Gas pressure: 600 Pa
High-frequency output: 35 W
Pulse frequency: 1000 Hz
Duty ratio (or Duty cycle): 0.25 (25% electric discharge)
Loading interval: 0.01 second Contact Resistance The respective samples were cut out into 60 mm × 10 mm and an emboss with a radius of curvature 5 mm was formed in the center part to produce test pieces of female terminals (substitution of female terminals). The respective samples were also cut out into 60 mm × 30 mm to be test pieces of male terminals (substitution of male terminals) as is in a flat plate shape.

Regarding these test pieces, using a friction abrasion tester (UMT-TriboLab made by Bruker AXS GmbH), contact resistance (mΩ) when the heat treatment was not performed and contact resistance (mΩ) when the heat treatment at 150° C. for 500 hours was performed were measured. Specifically, a protruded surface of the emboss of the test piece of the female terminal was in contact with the test piece of the male terminal which was horizontally disposed to apply a load 5 N on the test piece of the male terminal, the contact resistance value was measured by the four-terminal method.

Friction Coefficient

The respective samples were cut out into 60 mm × 10 mm and an emboss with a radius of curvature 5 mm was formed in the center part to produce test pieces of female terminals (substitution of female terminals). The respective samples were also cut out into 60 mm × 30 mm to be test pieces of male terminals (substitution of male terminals) as is in a flat plate shape.

Regarding the test pieces of the female terminals, test pieces in which the heat treatment was not performed (before heating) and test pieces after the heat treatment at 150° C. for 120 hours were produced and friction coefficient was measured respectively. The heat treatment was performed only on the test pieces of the female terminals; the respective test pieces of the male terminals were used for the measurement in a state before heating.

The friction coefficient was measured by using the friction abrasion tester (UMT-TriboLab made by Bruker AXS GmbH). Specifically, the protruded surface of the emboss of the test piece of the female terminal was in contact with the test piece of the male terminal which was horizontally disposed to apply a load 5 N on the test piece of the male terminal with moving it at a sliding speed 1.33 mm/sec for a distance 20 mm, continuous changes of the friction coefficient were measured, and average value in the movement distance from 10 mm to 15 mm was as the friction coefficient.

Fluctuation coefficient (%) was obtained by ((friction coefficient after heating -friction coefficient before heating) / (friction coefficient before heating)) × 100.

Results of these are shown in Table 1.

TABLE 1

| Sample | AgNi ALLOY PLATING CURRENT DENSITY (A/dm²) | FILM THICKNESS OF PLATING LAYER (μm) | | Ni CONTENT IN AgNi LAYER (at%) | CONTACT RESISTANCE (mΩ) | | FRICTION COEFFICIENT | | |
|---|---|---|---|---|---|---|---|---|---|
| | | AgNi | Ag | | BEFORE HEATING | AFTER HEATING | BEFORE HEATING | AFTER HEATING | FLUCTUATION COEFFICIENT (%) |
| 1 | 10 | 0.12 | 0.94 | 0.51 | 0.52 | 0.68 | 0.96 | 0.89 | -7.29 |
| 2 | 7 | 0.48 | 3.12 | 0.12 | 0.51 | 0.65 | 1.38 | 1.29 | -6.52 |
| 3 | 9 | 0.26 | 3.08 | 0.31 | 0.53 | 0.64 | 1.35 | 1.24 | -8.15 |
| 4 | 5 | 0.48 | 4.98 | 0.08 | 0.51 | 0.66 | 1.51 | 1.38 | -8.61 |
| 3 | 12 | 0.08 | 5.05 | 0.81 | 0.55 | 0.67 | 1.49 | 1.34 | -10.07 |
| 6 | 9 | 0.45 | 19.39 | 0.31 | 0.49 | 0.55 | 2.12 | 1.87 | -11.79 |
| 7 | – | 0 | 5.12 | – | 0.51 | 0.65 | 1.61 | 1.36 | -15.53 |
| 8 | 3 | 0.32 | 5.08 | 0.01 | 0.52 | 0.62 | 1.58 | 1.25 | -20.89 |
| 9 | 15 | 0.36 | 4.98 | 1.26 | 0.55 | 0.85 | 1.75 | 1.38 | -21.14 |
| 10 | – | Cu : 0.45 | 5.01 | – | 0.53 | 1.51 | 1.42 | 1.36 | -4.23 |
| 11 | 5 | 0.67 | 5.11 | 0.09 | 0.50 | 0.65 | 1.55 | 1.41 | -9.03 |

As shown from Table 1, in Samples 1 to 6 in which the film thickness of the silver-nickel alloy plating layer is 0.05 μm or more and less than 0.50 μm and the nickel content is 0.03 at% or more and 1.00 at% or less, the contact resistance is small, and the fluctuation before and after heating is small in the contact resistance and the friction coefficient, excellent heat resistance is shown. Note that even if the film thickness of the silver-nickel alloy plating layer is large as in Sample 11, the contact resistance and the friction coefficient are not further improved.

Figure 2:
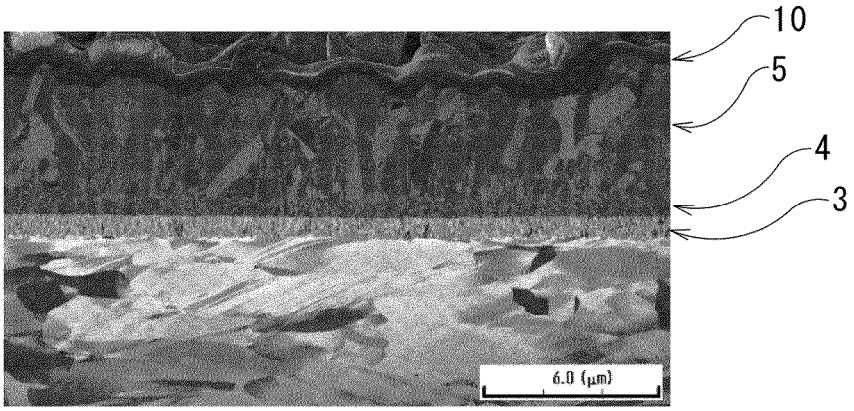
FIG. 2 It is an SIM (Scanning Ion Microscope) image of a cross section of a terminal material for a connector of Sample 4 before heating.

FIG. 2 is a sectional SIM image of Sample 4: the silver-nickel alloy plating layer 4 and the silver-plating layer 5 are formed on the nickel-plating layer 3 of the surface of the base material. A protective layer 10 on the silver-plating layer 5 is a layer formed for protection when the section machining was carried out using the focusing ion apparatus.

In Sample 7, since the silver-nickel alloy plating layer was not formed, the fluctuation of the friction coefficient was large; in Sample 8, since the Ni content in the silver-nickel alloy plating layer was small, the fluctuation of the friction coefficient was large.

Reason why the fluctuation of the friction coefficient was large before and after the heating treatment was considered that the surface of the nickel-plating layer was oxidized after the heat treatment, so that nickel-plating layer was peeled off from the silver-nickel alloy plating layer or the silver-plating layer by sliding while measuring the friction coefficient and the nickel-plating layer was even worn out. The friction coefficient was decreased by exposing of the hard nickel-plating layer, so that the friction coefficient was largely decreased comparing with that before the heating.

In Sample 9, since the Nickel content is large in the silver-nickel alloy plating layer, the contact resistance after the heating was large and the fluctuation of the friction coefficient owing to the peeling while sliding was also large. In Sample 10, since the copper layer was formed rather than the silver-nickel alloy layer, the contact resistance is large after heating.

Industrial Applicability

The heat resistance of the connector is improved, the contact resistance is not increased even in the high-temperature environment, and also the peeling can be restricted.

| Reference Signs List | |
|---|---|
| **1** | Terminal material for connector |
| **2** | Base material |
| **3** | Nickel-plating layer |
| **4** | Silver-nickel alloy plating layer |
| **5** | Silver-plating layer |
| **10** | Protective layer |

The invention claimed is:

1. A terminal material for a connector comprising a base material in which at least a surface layer is made of copper or copper alloy;

a nickel-plating layer made of nickel or nickel alloy and provided on a surface of the base material;

a silver-nickel alloy plating layer made of silver-nickel alloy and provided on at least a part of the nickel-plating layer; and a silver-plating layer made of silver and provided on the silver-nickel alloy plating layer, wherein the silver-nickel alloy plating layer has 0.05 μm or more and less than 0.50 μm of a film thickness and 0.03 at% or more and 1.00 at% or less of nickel content.

2. The terminal material for a connector according to claim 1, wherein a film thickness of the silver-plating layer is 0.5 μm or more and 20.0 μm or less.

3. The terminal material for a connector according to claim 2, wherein the silver-plating layer is made of silver with purity 99.99% or more by mass except C, H, S, O, and N which are gas components.

4. The terminal material for a connector according to claim 1, wherein the silver-plating layer is made of silver with purity 99.99% or more by mass except C, H, S, O, and N which are gas components.

* * * * *